US009683282B2

(12) United States Patent
Molz et al.

(10) Patent No.: US 9,683,282 B2
(45) Date of Patent: Jun. 20, 2017

(54) SYMMETRICAL MULTI-PORT POWDER INJECTION RING

(75) Inventors: Ronald J. Molz, Mt. Kisco, NY (US); James Leach, Enfield, CT (US)

(73) Assignee: OERLIKON METCO (US) INC., Westbury, NY (US)

( * ) Notice: Subject to any disclaimer, the term of this patent is extended or adjusted under 35 U.S.C. 154(b) by 2410 days.

(21) Appl. No.: 12/489,088

(22) Filed: Jun. 22, 2009

(65) Prior Publication Data

US 2010/0323117 A1 Dec. 23, 2010

(51) Int. Cl.

| | |
|---|---|
| ***H05H 1/42*** | (2006.01) |
| ***C23C 4/134*** | (2016.01) |
| ***B05B 7/22*** | (2006.01) |

(52) U.S. Cl.

CPC ..... *C23C 4/134* (2016.01); *B05B 7/226* (2013.01); *H05H 1/42* (2013.01)

(58) Field of Classification Search

CPC ..... H05H 1/42; H05H 1/34; B05B 7/226
USPC ..... 219/121.47, 121.48, 121.55, 121.59; 118/723 ER, 47, 641; 427/446; 422/186.04, 186.08, 906, 186.07, 186.18
See application file for complete search history.

(56) References Cited

U.S. PATENT DOCUMENTS

| | | | | |
|---|---|---|---|---|
| 3,332,870 | A | 7/1967 | Orbach et al. | |
| 5,679,167 | A | 10/1997 | Muehlberger | |
| 5,951,771 | A * | 9/1999 | Raney et al. | 118/723 ER |
| 7,342,196 | B2 | 3/2008 | Koenig | |
| 2006/0289404 | A1 | 12/2006 | Hawley et al. | |
| 2007/0138147 | A1 | 6/2007 | Molz et al. | |
| 2007/0298187 | A1 * | 12/2007 | Wigren et al. | 427/446 |

FOREIGN PATENT DOCUMENTS

| | | |
|---|---|---|
| EP | 1844175 | 8/2008 |
| GB | 943993 | 12/1963 |
| WO | 98/14634 | 4/1998 |

OTHER PUBLICATIONS

Search report from EPO that issued with respect to patent family member European Patent Application No. 10163225.5, mail date is Sep. 23, 2010.

* cited by examiner

*Primary Examiner* — Tu B Hoang
*Assistant Examiner* — Thomas Ward
(74) *Attorney, Agent, or Firm* — Greenblum & Bernstein, P.L.C.

(57) ABSTRACT

Powder injection apparatus, plasma gun, and method of use. Powder injection apparatus includes a shroud attachable to an outlet nozzle of a thermal spray apparatus and a substantially smooth and continuous inner wall defining a bowl through which a plume of the thermal spray apparatus travels. At least one port in the inner wall is structured and arranged to receive a powder injection nozzle that injects powder into the plume.

22 Claims, 7 Drawing Sheets

SYMMETRICAL MULTI-PORT POWDER INJECTION RING

BACKGROUND OF THE INVENTION

1. Field of the Invention

The invention relates generally to systems and methods for powder coating, and more specifically to a symmetrical multi-port powder injection ring.

2. Discussion of Background Information

A variety of thermal spray coatings are commonly used to protect various types of components. Coatings may provide various benefits such as, for example: resisting wear, inhibiting corrosion, controlling clearances, salvaging worn components, resisting high temperatures, enhancing electrical properties, etc. These benefits can differ based on the coating material type and how those materials are applied. One group of thermal spray coatings to which the subject matter of the present invention pertains in particular are those applied via the plasma spray process. This process has been used to apply many different types of coatings in numerous industries.

The plasma gun is commonly used as a process tool in the spray coatings industry due to the wide range of parameters that are achievable with this basic tool. The plasma thermal spray process basically involves spraying molten or heat softened material onto a substrate to form a coating. Feedstock material, typically in powder form, is injected into a high temperature plasma flame, also known as a plasma plume, where it is rapidly heated and accelerated, and subsequently impinged on a substrate that is intended to be coated.

In conventional plasma guns, the plasma plume is created using an arc internal to the gun and guided through an internal channel to an outlet nozzle. Powder for forming a coating onto a substrate is injected into the plasma plume by at least one powder injector. The powder injector may be located internally, e.g., prior to the outlet of the nozzle, or externally, e.g., downstream of the nozzle exit.

In conventional thermal spray devices, a known source of inefficiency is the fact that a large amount of the kinetic and thermal energy produced by the plasma gun is not transferred to the injected powder. Attempts at consuming this energy by simply increasing the amount of powder injected, for example by increasing the powder feed rate at each powder port and/or by increasing the number of injectors have resulted in a reduction of quality of the coating, as well as powder buildup on the face of the gun nozzle and the powder injectors. Similarly, attempts at solving the injection problem by using internal injection have resulted in powder buildup internal to the gun bore or inside the powder injectors.

As such, powder buildup on surfaces of the plasma gun is a problem with both internal and external powder injectors. Powder that is built up on hardware surfaces, e.g., surfaces of the powder injectors, surfaces of the plasma gun, etc., causes inefficiency by requiring that the plasma gun be shut down more often for cleaning. Additionally, powder buildup is indicative of an overall process inefficiency, since powder that is deposited on the plasma gun and other hardware is powder that does not get deposited as coating on the target substrate.

Accordingly, there exists a need in the art to overcome the above-noted deficiencies.

SUMMARY OF THE INVENTION

Exemplary embodiments and advantages of the present invention may be ascertained by reviewing the present disclosure and the accompanying drawings. In accordance with a first aspect of the invention, there is a powder injection apparatus including a shroud that is attachable to an outlet nozzle of a thermal spray apparatus. The shroud has a substantially smooth and continuous inner wall defining a bowl through which a plume of the thermal spray apparatus travels, and at least one port in the inner wall structured and arranged to receive a powder injection nozzle that injects powder into the plume.

In one embodiment, the at least one port has a plurality of ports. The plurality of ports may be arranged radially with respect to at least one of: a longitudinal axis of the shroud; a central axis of the outlet nozzle; and a longitudinal axis of the plume.

In an implementation of the invention, the apparatus includes a plurality of powder injection nozzles corresponding to the plurality of ports. An outlet end of each respective one of the plurality of powder injection nozzles may be substantially flush with the inner wall. Alternatively, an outlet end of each respective one of the plurality of powder injection nozzles may extend through the inner wall into a volume defined by the shroud. When the outlet ends of the plurality of powder injection nozzles extend through the inner wall, they may do so at a location downstream of an eddy current generated by the plume.

In a particular embodiment, the shroud is configured to at least partially enclose an eddy current generated by the plume. In a further embodiment, at least one of a diameter, a length, and a radius of curvature of the inner wall are sized to correspond to a predetermined toroidal vortex generated by the plume. In an even further embodiment, the thermal spray apparatus is a plasma gun and the plume is a plasma plume.

In accordance with another aspect of the invention, there is a plasma gun that includes an outlet nozzle for emitting a plasma plume and a powder injection apparatus. The powder injection apparatus has a shroud that is removably connected to the outlet nozzle. The shroud includes a substantially smooth and continuous inner wall defining a bowl through which the plasma plume travels, and at least one port in the inner wall structured and arranged to receive a powder injection nozzle that injects powder into the plasma plume.

In one embodiment, the at least one port is a plurality of ports. The plasma gun may also include a plurality of powder injection nozzles corresponding to the plurality of ports. An outlet end of each respective one of the plurality of powder injection nozzles may be substantially flush with the inner wall.

In another embodiment, the shroud is configured to at least partially enclose an eddy current generated by the plasma plume. In an even further embodiment, at least one of a diameter, a length, and a radius of curvature of the inner wall are sized to correspond to a predetermined toroidal vortex generated by the plasma plume.

According to another aspect of the invention, there is a method that includes injecting powder into a plume using a shroud attachable to an outlet nozzle of a thermal spray apparatus. The shroud has a substantially smooth and continuous inner wall defining a bowl through which a plume of the thermal spray apparatus travels, and at least one port in the inner wall structured and arranged to receive a powder injection nozzle that injects powder into the plume.

According to an even further aspect of the invention, there is a method that includes shrouding an eddy current generated by a plume exiting an outlet nozzle of a thermal spray device, and injecting powder into the plume downstream of the outlet nozzle through the eddy current. In one implementation, the shrouding includes surrounding the eddy current with a shroud having a bowl shape that is substantially symmetric about a longitudinal axis of travel of the plume and that corresponds to a geometry of the eddy current. In another implementation, the shrouding includes positioning a shroud around the outlet nozzle, while the injecting includes guiding the powder through the shroud.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention relates generally to systems and methods for plasma spray powder coating. In various embodiments, a symmetrical multi-port powder injection ring is arranged externally at an outlet nozzle of a plasma gun. The powder injection ring includes a shroud that is sized and shaped to influence air flow in the vicinity of the outlet nozzle. In particular embodiments, the shroud substantially prevents disruption of the flow field, which may include eddy currents, in the vicinity of the outlet nozzle of the plasma gun. By protecting the flow field at the outlet nozzle, the shroud minimizes turbulent conditions that can disrupt the delivery of powder from the powder injection nozzles to the plasma plume. In this manner, implementations of the invention deliver powder to the plasma plume more efficiently, which minimizes powder buildup and increases overall process efficiency.

Embodiments of the invention are described herein with respect to a plasma gun system. However, the invention is not limited to use with a plasma gun. Thus, implementations of the invention may be utilized with any thermal spray system, including but not limited to: combustion flame spraying with powder, high velocity oxygen fuel (HVOF) spray processes, etc. Aspects of the invention are also applicable to both subsonic and supersonic plasma guns.

Figure 1:
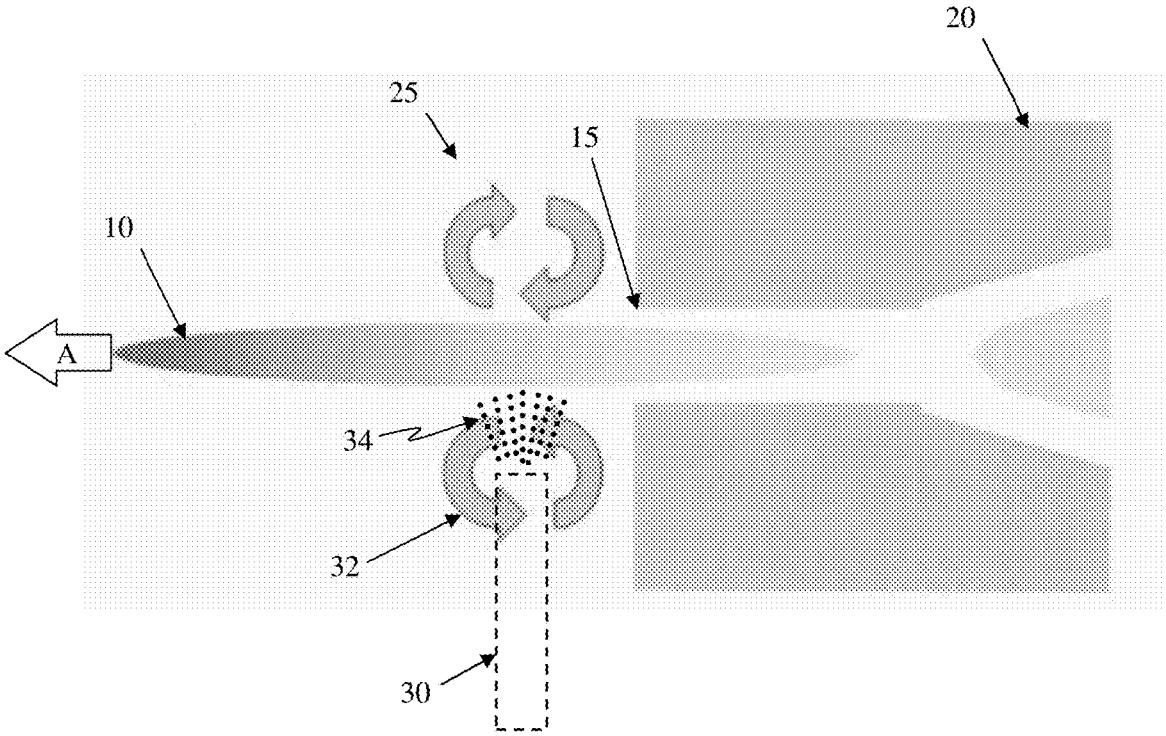
FIG. 1 shows a computational flow diagram (CFD) schematic representation of a plasma plume in accordance with aspects of the invention.

FIG. 1 shows a computational flow diagram (CFD) schematic representation of a plasma plume 10 exiting an outlet nozzle 15 of a plasma gun 20. The plasma plume 10, through its axial velocity in the direction of arrow "A" and outward expansion, interacts with the ambient air as the plasma plume 10 exits the nozzle 15. This interaction produces an eddy current, or back flow, 25 in the vicinity of the outlet nozzle 15. When the flow field at the nozzle 15 is left undisturbed, the eddy current 25 is fairly consistent and uniform, and can take the shape of a toroidal vortex, also referred to as a vortex ring.

However, when a discontinuity is introduced into the flow field, for example by an external powder injector 30 and/or a structure holding an external powder injector, the uniform back flow 32 can be disrupted. Using high speed imaging, it is possible to show that such disruptions result in at least a side deflection of the primary eddy current 25 and, thereby, the formation of new eddy currents. As a result, the eddy current 25 can be broken up into a number of new individual swirl patterns that eventually lead to highly turbulent flow conditions in the vicinity of the powder injector 30 and the plasma plume 10. The highly turbulent flow disrupts the intended flow of powder 34 from the injector 30 to the plasma plume 10, such that instead of being injected into and dispersed within the plasma plume 10, the powder 34 is carried away from the plasma plume 10 by the new individual swirl patterns. This disadvantageously decreases process efficiency and results in undesirable powder buildup on the various exposed surfaces such as on the powder injector 30 and on the plasma gun 20.

Alternatively, or in addition to the aforementioned structural discontinuities in the flow field, such as external powder injectors 30 and associated mounting hardware, the eddy current 25 can also be influenced by ambient conditions in the vicinity of the nozzle 15. For example, plasma guns are often operated in an enclosed room or booth through which ambient air is continuously circulated using, for example, forced air circulation. The circulation of the ambient air can also lead to disruptions of the eddy current 25, thereby resulting in increased turbulence between the powder injector 30 and the plasma plume 10, and in the above noted disadvantages.

It has been determined through empirical testing that simply increasing the mass flow rate of powder 34 through the external powder injector 30 does not alleviate the problems caused by the turbulence. Moreover, empirical testing has revealed that simply increasing the number of external powder injectors 30 also fails to lessen the undesired effects of the turbulent flow that results from disrupting the flow field adjacent the nozzle 15.

Figure 2:
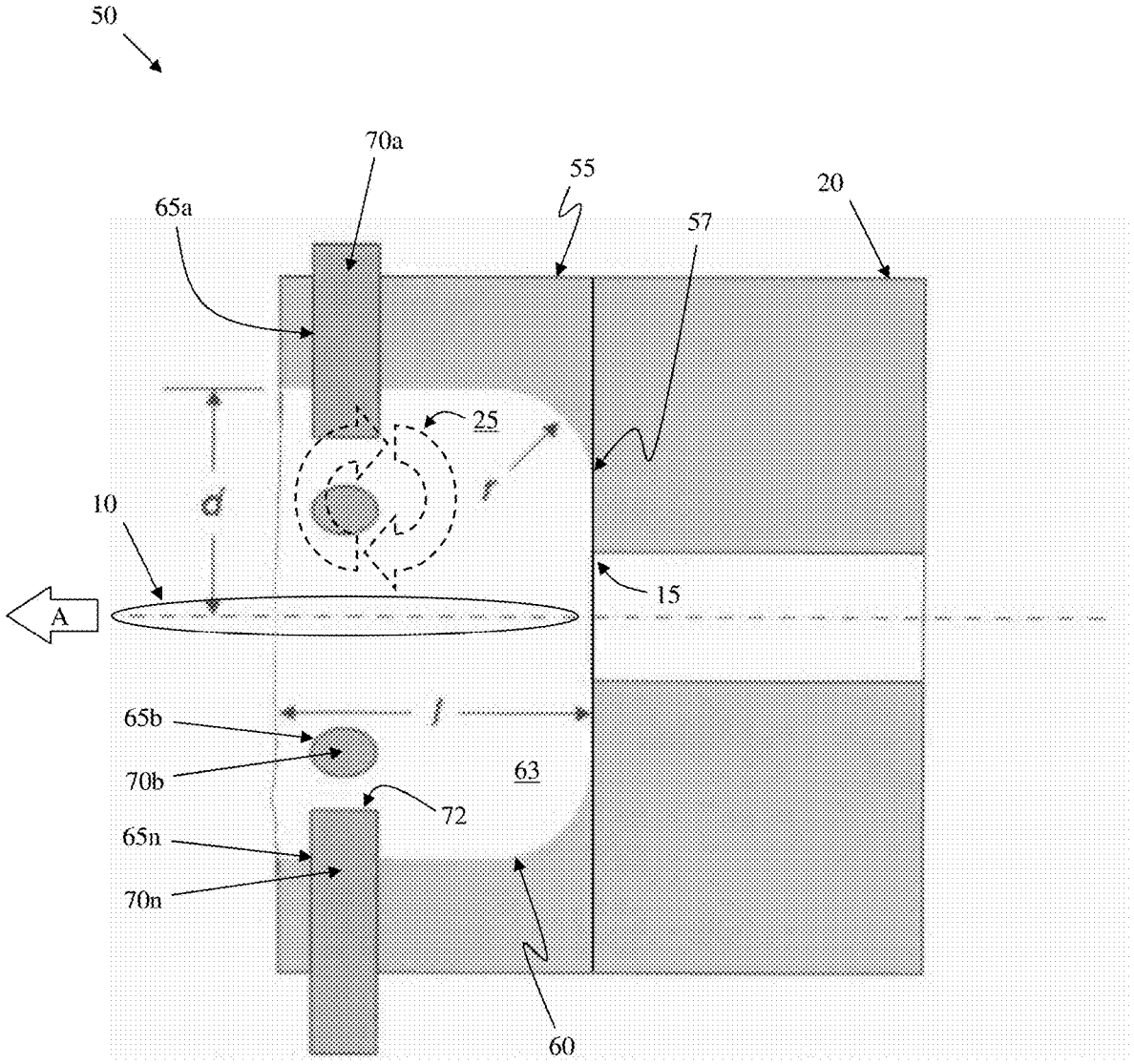
FIG. 2 shows a schematic representation of a symmetrical multiport powder injection ring in accordance with aspects of the invention.

Accordingly, in an embodiment of the invention, a symmetrical multiport powder injection ring that protects and maintains the eddy current 25 is provided at the outlet of the plasma gun. As depicted in FIG. 2, the powder injection ring 50 includes a shroud 55 having a first face 57 that fits or is positionable substantially flush with the outlet nozzle 15 of the plasma gun 20. The shroud 55 is either attached or removably connected to the outlet nozzle 15 of the plasma gun 20. In this embodiment, the shroud 55 has a substantially smooth and continuous interior wall 60 that forms a bowl 63 or concave portion that is sufficiently sized to contain the flow field where the eddy current 25 is generated by the plasma plume 10 exiting nozzle 15. For example, in a particular embodiment, the bowl 63 has a circular bottom interior surface and a cylindrical side surface connected at the perimeter of the bottom surface by a curved surface having a radius of curvature, as described in greater detail below, although the invention is not limited to this particular shape. The bowl 63 may be substantially symmetric about a longitudinal axis of travel of the plasma plume 10 and may be substantially flush with the nozzle 15, so as to minimize any flow field disruptions in the vicinity of the nozzle 15. The shroud 55 may also include one or more ports 65*a*, 65*b*, . . . , 65*n* (collectively referred to as element 65) through the interior wall 60 for accommodating one or more powder injectors 70*a*, 70*b*, . . . , 70*n* (collectively referred to as element 70) arranged to inject powder into a plasma plume exiting the nozzle 15.

In accordance with aspects of the invention, the bowl 63 is sized and shaped to contain and maintain the eddy current 25 that would naturally occur at the outlet nozzle 15 for a given plasma plume. For example, the diameter "d," radius "r" and length "l" may vary depending on the plasma plume exit diameter and plume energy state, which will affect the size and shape of the eddy current.

In this embodiment, the diameter "d," radius "r" and length "l" are empirically determined by observing the flow field, including the eddy current 25, of the plasma gun 20 without the shroud 55 in place. More specifically, the eddy current 25, shown for example as a toroidal vortex, may be observed using a laser strobe and high speed imaging equipment while introducing small amounts of powder in the vicinity of the plasma plume. The small amount of powder becomes entrained in the eddy current without substantially disrupting the eddy current, such that the size and shape of the eddy current can be determined for a given operational state of the plasma gun 20.

According to another embodiment of the invention, the length "l" may range from about 10 mm to about 30 mm. However, the invention is not limited to these values and any desired length "l" may be used depending on the size and shape of the eddy current. For example, longer bowls may be used by extending the shroud 55 to accommodate powder injection, for example at ports 65, further downstream from the outlet nozzle 15.

In another embodiment, the diameter "d" may range from about 15 mm to about 25 mm. However, the invention is not limited to these values and any desired diameter "d" may be used depending on the size and shape of the eddy current. For example, the diameter "d" may be sized large enough to accommodate the natural eddy current in the vicinity of the face of the nozzle without hindering the natural flow pattern, but without being so large as to allow external flow conditions such as forced air circulation to adversely affect the eddy current.

According to another embodiment, the radius "r" is normally about half the value of the diameter "d." For example, the radius "r" may range from about 6 mm to about 15 mm, although the invention is not limited to these values, and any desired radius "r" may be used depending on the size and shape of the eddy current.

By appropriately selecting the sizes of the diameter "d," radius "r" and length "l," and by providing a smooth inner wall 60, the bowl 63 is configured, e.g., sized and shaped, to surround the eddy current 25 without disrupting the eddy current 25. In this manner, obstructions that may disrupt the eddy current 25 are effectively eliminated and, as a result, the highly turbulent flow in the vicinity of the powder injectors 70 is reduced or essentially eliminated. Accordingly, implementations of the invention provide more efficient powder delivery from the powder injectors to the plasma plume, which results in increased process efficiency and reduced powder buildup on hardware surfaces.

Figure 3:
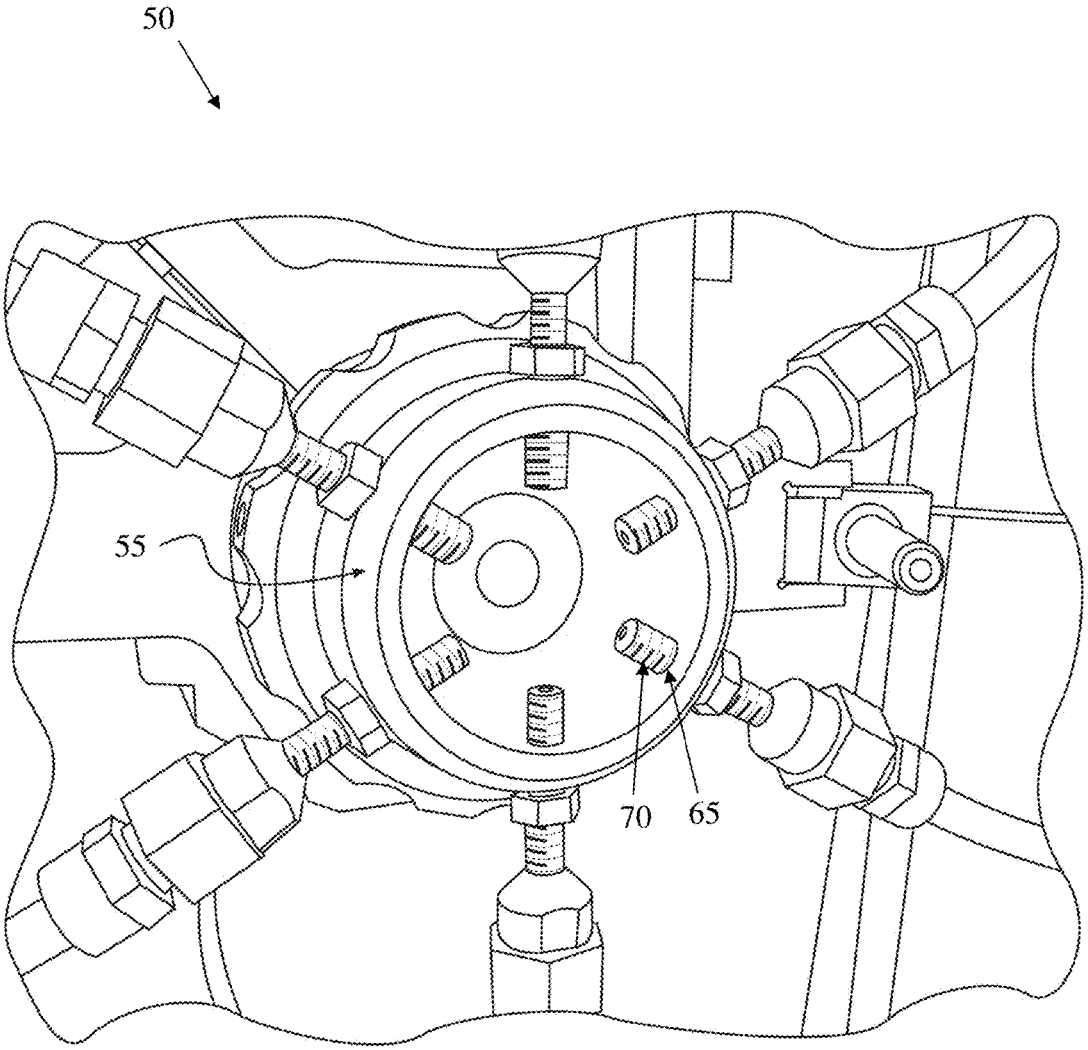
FIG. 3 shows a symmetrical multiport powder injection ring in accordance with aspects of the invention.

FIG. 3 shows an exemplary symmetrical multiport powder injection ring 50 in accordance with one aspect of the invention. The injection ring 50 is shown having six ports 65 arranged symmetrically radially about the longitudinal axis of shroud 55, which substantially corresponds to the longitudinal axis of the plasma plume. In another embodiment, the ports 65 are threaded to accommodate corresponding threads of respective powder injectors 70. However, the invention is not limited to six ports 65, and it is understood that any number of ports arranged symmetrically about the longitudinal axis may be used within the scope of the invention, for example 2, 3, 4, 5, 6, etc. Moreover, it should be understood that the invention is not limited to threaded ports 65, such that any other suitable type of connection, for example friction fit, quick disconnect, etc., may be provided for mounting the powder injectors 70 in the ports 65.

Figure 4:
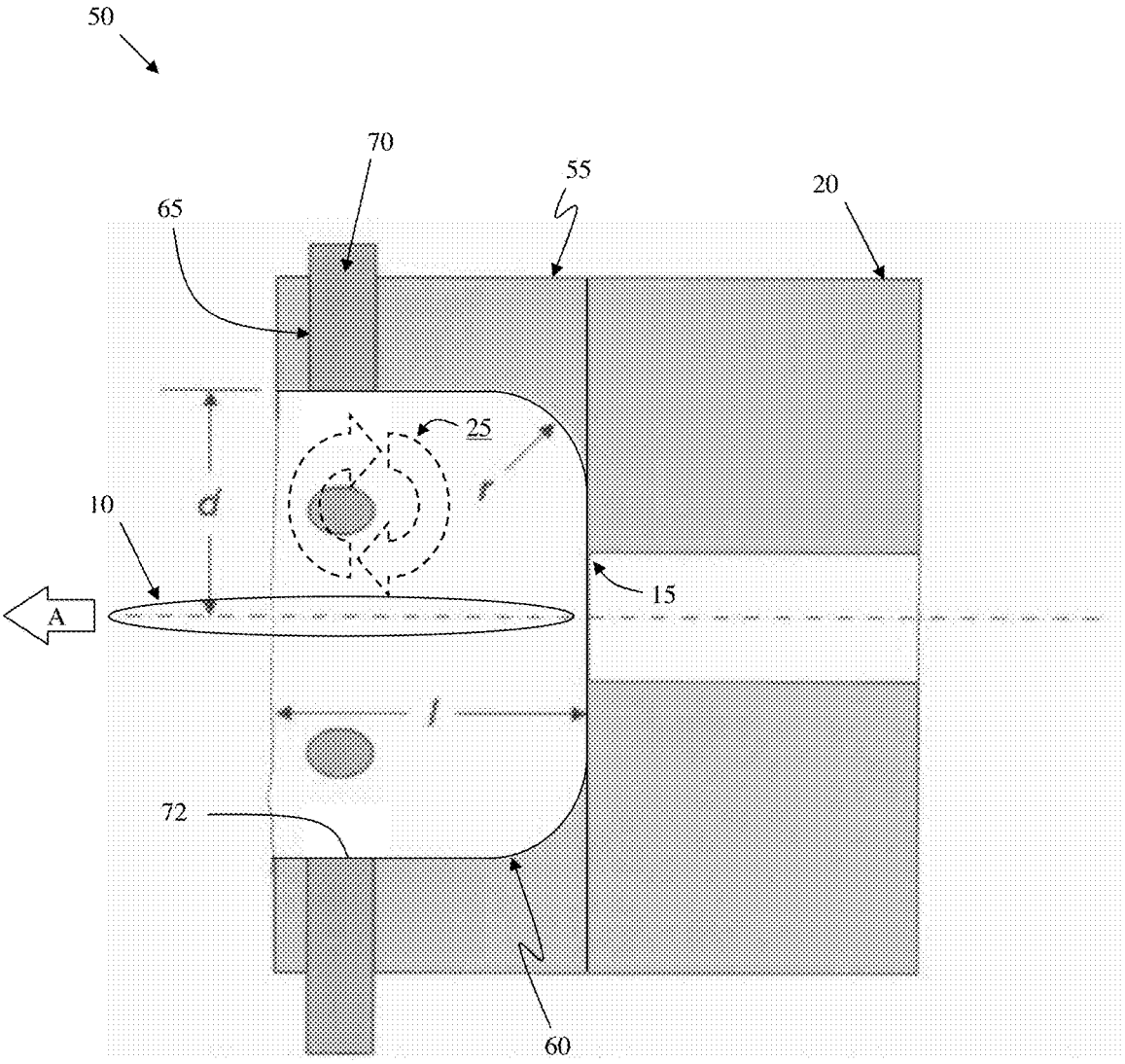
FIG. 4 shows a schematic representation of a symmetrical multiport powder injection ring in accordance with aspects of the invention.

In another embodiment, the outlet end 72 of each powder injector 70 is flush with the inner wall 60 of the shroud 55, as depicted in FIG. 4. By being flush with the inner wall 60, the powder injectors 70 do not protrude into the volume defined by the bowl 63 and, therefore, will not disrupt the eddy current.

However, operational parameters of the plasma gun, for example plasma plume diameter, etc., may require that the outlet end 72 of each powder injector 70 be within the volume defined by the bowl 63, for example, as depicted in FIG. 3. The distance between the exit of each powder injector 70 and the plasma plume 10 may be determined according to operational parameters of the plasma gun 20. By arranging the powder injectors 70 symmetrically within the bowl 63, any disruptions that do occur are symmetrically dispersed within the eddy current, so as to minimize the overall disruption of the eddy current.

In a specific embodiment, the portion of the powder injectors 70 that extends into the bowl 63 is substantially smooth. For example, while a threaded connection may be used to connect the powder injectors 70 to the shroud 55, the portion of the powder injectors 70 extending into the bowl 63 may have a substantially smooth outer surface. In a preferred embodiment, the portion of the powder injectors 70 extending into the bowl 63 is substantially cylindrical and has a smooth outer wall, with an inside diameter of about 1.5 mm to about 2.0 mm and a wall thickness of about 0.5 mm.

In an even further embodiment, the powder injectors 70 may be arranged downstream of the eddy current 25. For example, the shroud 55 may be sized and arranged to contain the eddy current 25 in a predefined volume, and the powder injectors 70 may be arranged downstream of this volume, downstream being defined by the direction of flow of the plasma plume 10.

In another embodiment, the shroud 55 is composed of yellow brass. However, the invention is not limited to this material, and other materials may be used. For example, the shroud may be constructed of any suitable material including, but not limited to, brass, stainless steel, alloys, composites, ceramics, etc.

In further embodiments, the shroud 55 may be water cooled, forced air cooled, and/or convection cooled. The type of cooling may depend on, for example, the plasma gun power level, for example the heat generated at the shroud 55, and geometry of the shroud 55. For example, at least one passageway constituting an internal water jacket (not shown) may be formed in solid material of the shroud 55, for example, during manufacturing of the shroud 55. In this manner, cooling fluid may be circulated through the water jacket for regulating the temperature of the shroud 55 during operation of the plasma gun 20. Additionally or alternatively, an externally arranged heat sink may be connected in thermal communication with the shroud 55.

As described herein, implementations of the invention may be used with any suitable thermal spray process, including, but not limited to: plasma guns both subsonic and supersonic, combustion flame spraying with powder, HVOF spray processes, etc. In each case, the dimensions of the shroud 55 may be optimized based on process parameters, such as the size of the plume, the size of the eddy current, etc.

Exemplary Implementation

By improving the travel/transfer of the powder from the powder injectors 70 to the plasma plume 10, implementations of the invention permit conventional plasma guns to operate at higher powder feed rates while maintaining other process parameters, for example particle temperature, particle velocity, etc., relatively constant. In this manner, implementations of the invention operate to significantly increase the overall process efficiency of a plasma gun.

For example, first generation plasma guns typically operate with a powder feed rate of about 10 to 60 grams/minute, at a process efficiency of less then 10%, and at a deposit efficiency of about 70%. In contrast, modern plasma guns such as, for example, the TRIPLEXPRO available from SULZER METCO (US) Inc. of Westbury, N.Y. can typically operate with a powder feed rate of about 100-180 grams/minute, at process efficiencies up to about 12%, and at a deposit efficiency of about 75%. However, when equipped with a symmetrical multi-port powder injection ring in accordance with aspects of the invention, the TRIPLEXPRO can achieve powder feed rates of about 220 to 400 grams/minute, at process efficiencies of about 15% to about 28%, with the same deposit efficiency of about 75%.

In a particular example, the symmetrical multi-port powder injection ring 50 depicted in FIG. 3 was installed on and tested with a TRIPLEXPRO plasma gun using AlSi 40% polyester powder. Operational data of the plasma gun using the shroud is tabulated in Table 1. The first row of data in Table 1 having the Feed Rate of 180 g/min substantially corresponds to operational data that was achieved with the TRIPLEXPRO plasma gun using a conventional external 3-port powder injection system, i.e., without the shroud. The subsequent lines of data having Feed Rates of 220 through 400 g/min correspond to the TRIPLEXPRO plasma gun operating with an implementation of a symmetrical multi-port powder injection ring in accordance with aspects of the invention as shown in FIG. 3. In all cases the same gun operating parameter were used with the exception of the powder feed rate.

TABLE 1

| Feed Rate (g/min) | Particle Temp (c.) | Particle Vel (m/sec) | Particle Energy (W-h/g) | Process Efficiency (%) | % Improvement |
|---|---|---|---|---|---|
| 180 | 2125 | 348 | 0.668 | 12.5 | 0 |
| 220 | 2134 | 346 | 0.67 | 15.2 | 22% |
| 260 | 2175 | 347 | 0.68 | 18 | 44% |
| 300 | 2198 | 342 | 0.685 | 20.5 | 64% |
| 330 | 2228 | 338 | 0.692 | 22.9 | 83% |
| 360 | 2132 | 331 | 0.667 | 24.9 | 99% |
| 400 | 2158 | 325 | 0.672 | 27.7 | 122% |

As seen from Table 1, when utilizing implementations of the invention, the measured particle velocity, particle temperature, and particle energy are substantially similar to that which would normally be obtained with a conventional powder injection arrangement. Also, although not shown, the deposit efficiency, for example the ratio of powder input to the system to powder deposited onto the target substrate, is substantially the same for conventional systems and for systems utilizing implementations of the invention. However, when using implementations of the invention, the powder feed rate is substantially higher than conventional systems. Accordingly, the process efficiency increases since a greater amount of powder is fed at the same deposit efficiency while using substantially the same amount of input energy.

Figure 5:
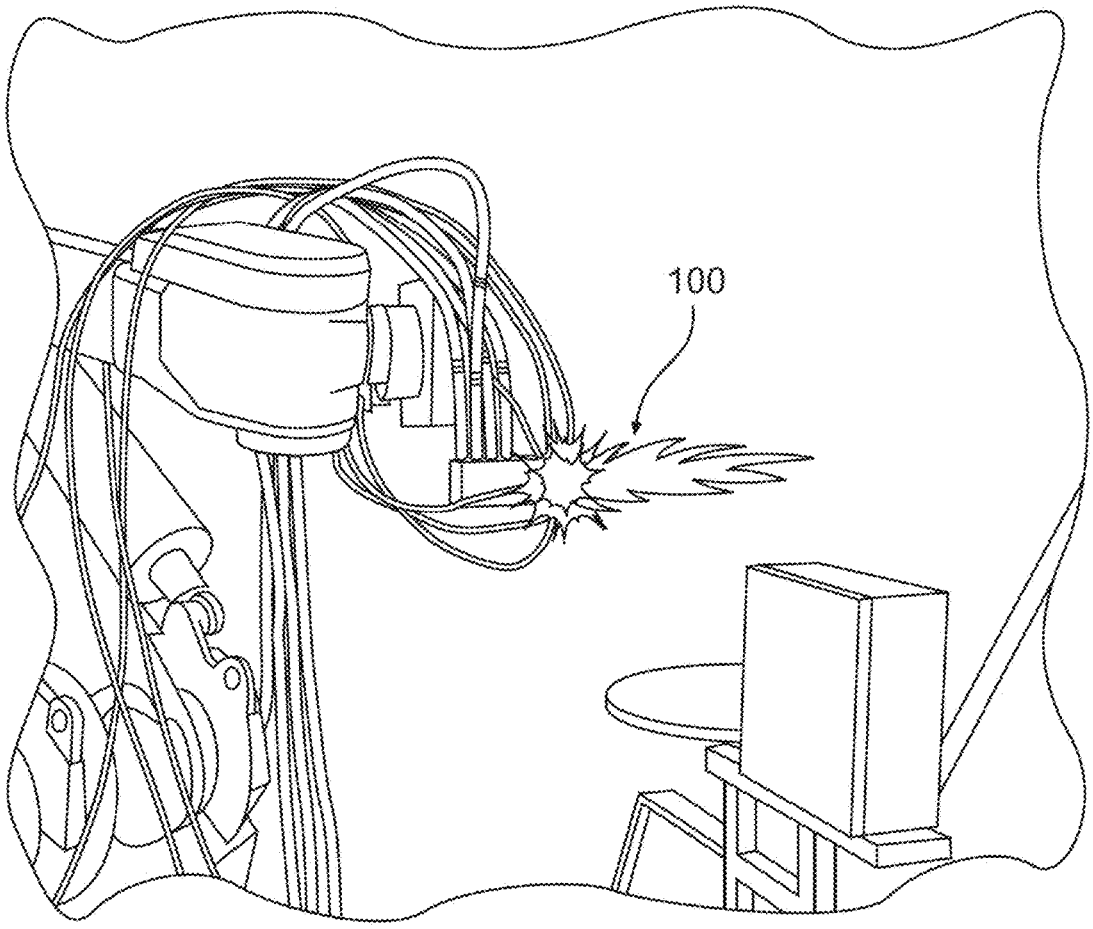
FIG. 5 shows an image of a plasma plume produced with a symmetrical multiport powder injection ring in accordance with aspects of the invention.

FIG. 5 shows an image of a plasma plume 100 of a plasma gun equipped with a symmetrical multi-port powder injection ring similar to that depicted in FIG. 3, with a powder flow rate of about 300 grams/minute. Plasma guns equipped with conventional external powder injectors typically exhibit streaks of powder within the plasma plume, as the powder injected into the plasma plume is not fully dispersed within the plasma plume. However, as seen in FIG. 5, implementations of the invention provide a powder plume that essentially comprises the entire plasma plume without exhibiting streaking. As such, by using embodiments of the invention, the powder is better dispersed within the plasma plume and more powder can be delivered to the target substrate using substantially the same plasma plume as a conventional system.

Figure 6:
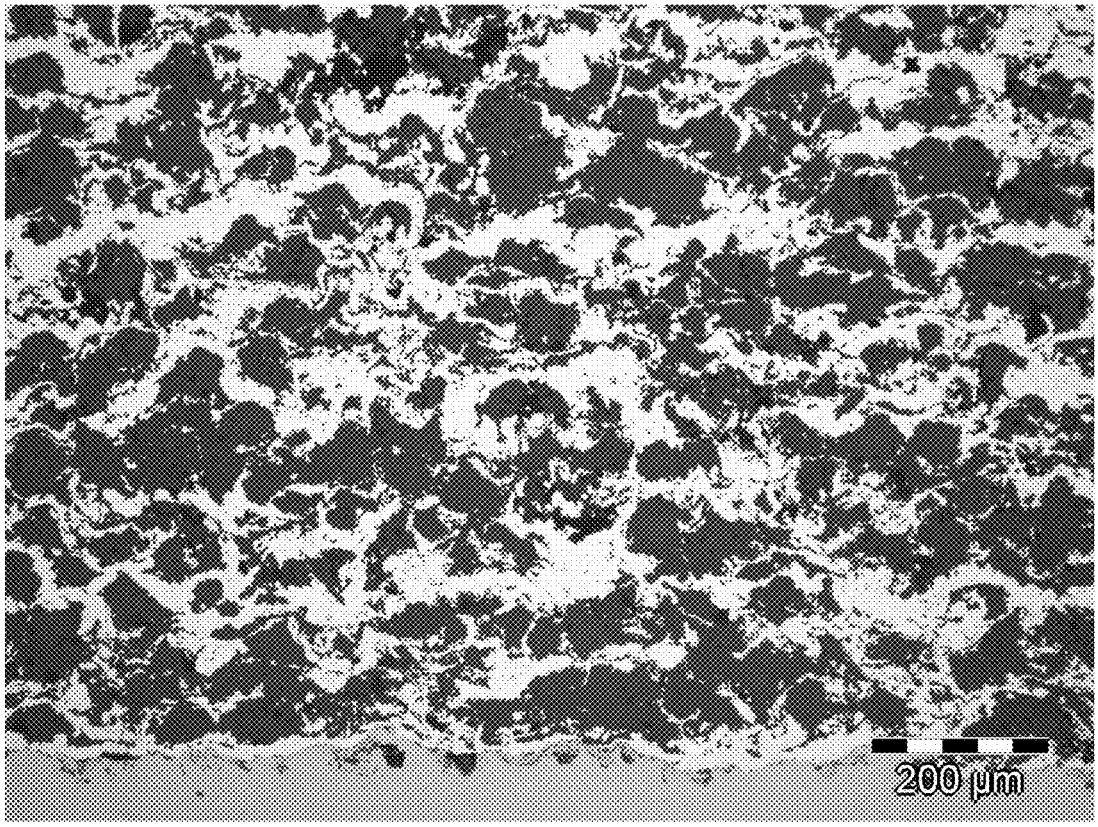
FIG. 6 shows a microscopic photograph of an abradable coating produced using a symmetrical multi-port powder injection ring in accordance with aspects of the invention.

FIG. 6 shows a microscopic photograph of an abradable coating produced using a symmetrical multi-port powder injection ring and a powder feed rate of about 300 grams/minute in accordance with aspects of the invention. The coating properties of the abradable coating shown in FIG. 6 are well within aerospace specifications for this type of coating.

Figure 7:
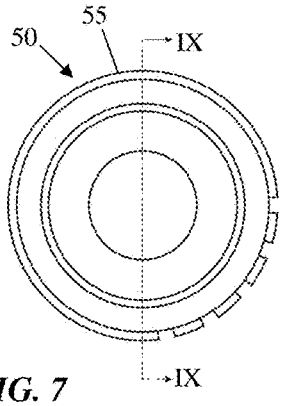
FIGS. 7-11 depict an embodiment of a symmetrical multiport powder injection ring in accordance with aspects of the invention.
Figure 8:
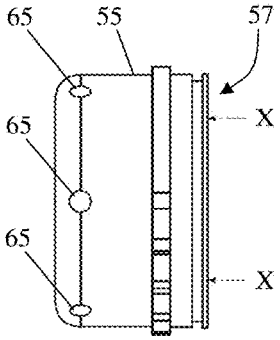
Figure 9:
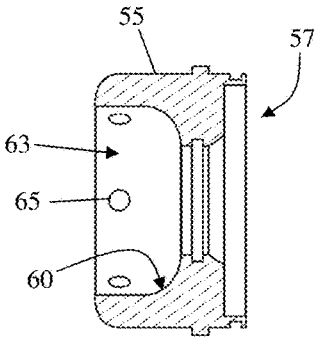
Figure 10:
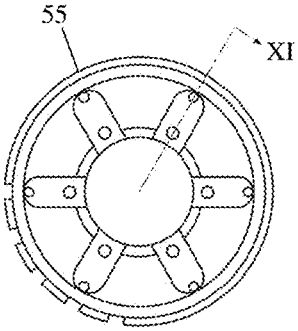
Figure 11:
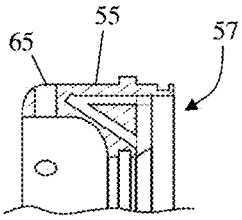

FIGS. 7-11 depict an embodiment of a symmetrical multiport powder injection ring 50 in accordance with aspects of the invention. Particularly, FIG. 7 shows a front view of a powder injection ring 50 comprising a shroud 55 as described herein. FIG. 8 shows a side view of the shroud 55, and further depicts ports 65 for accommodating powder injectors (not shown) and a first face 57 that interfaces with a plasma gun (not shown). FIG. 9 shows a cutaway side view of the shroud taken along lines IX-IX of FIG. 7. The interior wall 60 forming the bowl 63 is depicted in FIG. 9. FIG. 10 shows a rear view of the shroud 55 taken along arrows X-X of FIG. 8. FIG. 11 shows a partial cutaway view of the shroud 55 taken along line XI of FIG. 10.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A powder injection apparatus, comprising:

a shroud attachable to an outlet nozzle of a thermal spray apparatus, wherein the shroud comprises:

a substantially smooth and continuous inner wall defining a bowl through which a plume of the thermal spray apparatus travels, and at least one port in the inner wall structured and arranged to receive a powder injection nozzle that injects powder into the plume.

2. The apparatus of claim 1, wherein the at least one port comprises a plurality of ports.

3. The apparatus of claim 2, wherein the plurality of ports are arranged radially with respect to at least one of:

a longitudinal axis of the shroud;

a central axis of the outlet nozzle; and a longitudinal axis of the plume.

4. The apparatus of claim 2, further comprising a plurality of powder injection nozzles corresponding to the plurality of ports.

5. The apparatus of claim 4, wherein an outlet end of each respective one of the plurality of powder injection nozzles is substantially flush with the inner wall.

6. The apparatus of claim 4, wherein an outlet end of each respective one of the plurality of powder injection nozzles extends through the inner wall into a volume defined by the shroud.

7. The apparatus of claim 6, wherein the outlet ends of the plurality of powder injection nozzles extend through the inner wall at a location downstream of an eddy current generated by the plume.

8. The apparatus of claim 1, wherein the shroud is configured to at least partially enclose an eddy current generated by the plume.

9. The apparatus of claim 1, wherein at least one of a diameter, a length, and a radius of curvature of the inner wall are sized to correspond to a predetermined toroidal vortex generated by the plume.

10. The apparatus of claim 1, wherein the thermal spray apparatus is a plasma gun and the plume is a plasma plume.

11. A plasma gun, comprising:

an outlet nozzle for emitting a plasma plume; and an powder injection apparatus comprising a shroud removably connected to the outlet nozzle, wherein the shroud comprises:

a substantially smooth and continuous inner wall defining a bowl through which the plasma plume travels, and at least one port in the inner wall structured and arranged to receive a powder injection nozzle that injects powder into the plasma plume.

12. The plasma gun of claim 11, wherein the at least one port comprises a plurality of ports.

13. The plasma gun of claim 12, further comprising a plurality of powder injection nozzles corresponding to the plurality of ports.

14. The plasma gun of claim 13, wherein an outlet end of each respective one of the plurality of powder injection nozzles is substantially flush with the inner wall.

15. The plasma gun of claim 11, wherein the shroud is configured to at least partially enclose an eddy current generated by the plasma plume.

16. The plasma gun of claim 11, wherein at least one of a diameter, a length, and a radius of curvature of the inner wall are sized to correspond to a predetermined toroidal vortex generated by the plasma plume.

17. A method, comprising:

injecting powder into a plume using a shroud attachable to an outlet nozzle of a thermal spray apparatus, wherein the shroud comprises:

a substantially smooth and continuous inner wall defining a bowl through which a plume of the thermal spray apparatus travels, and at least one port in the inner wall structured and arranged to receive a powder injection nozzle that injects powder into the plume.

18. A method, comprising:

shrouding an eddy current generated by a plume exiting an outlet nozzle of a thermal spray device, and injecting powder into the plume downstream of the outlet nozzle through the eddy current wherein the shrouding comprises surrounding the eddy current with a shroud having a bowl shape that is substantially symmetric about a longitudinal axis of travel of the plume and that corresponds to a geometry of the eddy current and wherein the bowl shape is open in a direction of the plume travel.

19. The method of claim 18, wherein:

the shrouding comprises positioning a shroud around the outlet nozzle; and the injecting comprises guiding the powder through the shroud.

20. The apparatus of claim 1, wherein the bowl is open in a direction of the plume travel.

21. The plasma gun of claim 11, wherein the bowl is open in a direction of the plume travel.

22. The method of claim 17, wherein the bowl is open in a direction of the plume travel.

* * * * *